US007907867B2

(12) United States Patent
Moro et al.

(10) Patent No.: US 7,907,867 B2
(45) Date of Patent: Mar. 15, 2011

(54) CREEP RESISTANT CLEANING DEVICE AND IMAGE FORMING DEVICE HAVING THE SAME

(75) Inventors: Fuminori Moro, Toyokawa (JP); Shoichi Yoshikawa, Okazaki (JP); Toshiyuki Sakai, Shinshiro (JP); Hiroshi Ibaraki, Okazaki (JP); Takayuki Ito, Kiyosu (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 346 days.

(21) Appl. No.: 11/418,215

(22) Filed: May 5, 2006

(65) Prior Publication Data

US 2007/0147876 A1 Jun. 28, 2007

(30) Foreign Application Priority Data

Dec. 28, 2005 (JP) ..... 2005-377434

(51) Int. Cl.
*G03G 15/16* (2006.01)

(52) U.S. Cl. ..... 399/101; 399/123; 399/297; 399/345; 399/358; 399/350; 399/357

(58) Field of Classification Search ..... 399/101, 399/123, 297, 345, 358, 350, 357
See application file for complete search history.

(56) References Cited

U.S. PATENT DOCUMENTS 3,977,898 A * 8/1976 Hwa ..... 399/350
4,357,098 A * 11/1982 Endo ..... 399/350
5,390,010 A * 2/1995 Yamahata et al. ..... 399/345
5,991,568 A 11/1999 Ziegelmuller et al.
6,760,554 B2 * 7/2004 Fina et al. ..... 399/351
2005/0135844 A1 * 6/2005 Takenouchi et al. ..... 399/297
2005/0196205 A1 * 9/2005 Osawa ..... 399/345
2006/0034632 A1 * 2/2006 Takada et al. ..... 399/350

FOREIGN PATENT DOCUMENTS

JP 02-021659 U 2/1990
JP 04-342287 A 11/1992
JP 11-296001 10/1999
JP 2002-351285 12/2002

OTHER PUBLICATIONS

Office Action in JP 2005-377434 dated Feb. 17, 2009.
English language translation of Office Action in JP 2005-377434 dated Feb. 17, 2009.
Japanese Office Action dated May 19, 2009 issued in the corresponding Japanese Patent Application No. 2005-377434 and English-language translation.

* cited by examiner

*Primary Examiner* — David M Gray
*Assistant Examiner* — Ryan D Walsh
(74) *Attorney, Agent, or Firm* — Buchanan Ingersoll & Rooney PC

(57) ABSTRACT

There is provided a cleaning device capable of maintaining a sufficient cleaning effect by preventing creep deformation of a cleaning member. The cleaning device of the present invention for cleaning a transfer body in an image forming apparatus includes a first cleaning member whose top end is brought into pressure contact with the transfer body, and a second cleaning member which is placed downstream from the first cleaning member with respect to a moving direction of the transfer body and whose top end is brought into pressure contact with the transfer body, wherein the second cleaning member is provided rotatably with respect to the first cleaning member.

24 Claims, 13 Drawing Sheets

CREEP RESISTANT CLEANING DEVICE AND IMAGE FORMING DEVICE HAVING THE SAME

RELATED APPLICATION

This application is based on Japanese Patent Application No. 2005-377434, the content of which is incorporated herein by reference.

BACKGROUND OF THE INVENTION

The present invention relates to a cleaning device for an intermediate transfer body for use in an image forming apparatus for forming images with use of the intermediate transfer body.

Known as one of the conventional electrophotographic image forming apparatuses is an image forming apparatus in which a developer image formed on a photoreceptor is primarily transferred onto an intermediate transfer body and then the developer image is secondarily transferred from the intermediate transfer body to a paper sheet. Such an image forming apparatus normally has a cleaning device for removing undesired substances such as residual developers on the intermediate transfer body after the secondary transfer as well as paper powders and dust attached onto the surface of the intermediate transfer body.

The cleaning device is typified by those removing the residual developer and the like by bringing a metal or rubber blade into pressure contact with the surface of the intermediate transfer body. In order to cope with the case where such a blade cannot provide a sufficient cleaning effect or the case where it is necessary to remove a so-called separation streak, which are a streak formed by a residual developer having been already collected by the blade when the blade is separated from the intermediate transfer body, a technology for placing a seal member serving as another cleaning member on the surface of the intermediate transfer body on the downstream side of the blade with respect to the moving direction has been proposed.

However, the conventional technology for placing the seal member on the downstream side of the blade has such a problem that the seal member suffers creep deformation with the elapse of time and this hinders fulfillment of a sufficient cleaning effect.

Moreover, a cleaning device having a seal member placed on the upstream side of a blade, which has been disclosed in U.S. Pat. No. 5,991,568, is not capable of cleaning the separation streak remaining when the blade is separated from the intermediate transfer body.

SUMMARY OF THE INVENTION

An object of the present invention is to provide a cleaning device capable of maintaining a sufficient cleaning effect by preventing creep deformation of the cleaning member.

In order to accomplish the object, the cleaning device of the present invention for cleaning a transfer body in an image forming apparatus includes: a first cleaning member whose top end is brought into pressure contact with the transfer body; and a second cleaning member which is placed downstream from the first cleaning member with respect to a moving direction of the transfer body and whose top end is brought into pressure contact with the transfer body, wherein the second cleaning member is provided rotatably with respect to the first cleaning member.

Moreover, an image forming apparatus of the present invention includes: a transfer body for retaining an image formed with a developer; and a cleaning device for cleaning the transfer body, wherein the cleaning device includes: a first cleaning member whose top end is brought into pressure contact with the transfer body; and a second cleaning member which is placed downstream from the first cleaning member with respect to a moving direction of the transfer body so at to be rotatable with respect to the first cleaning member and whose top end is brought into pressure contact with the transfer body.

According to the cleaning device and the image forming apparatus having the same in the present invention, the second cleaning member disposed downstream from the first cleaning member is rotatably provided, so that creep deformation of the second cleaning member can be prevented and sufficient cleaning performance can be maintained.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE PREFERRED EMBODIMENTS

Figure 1:
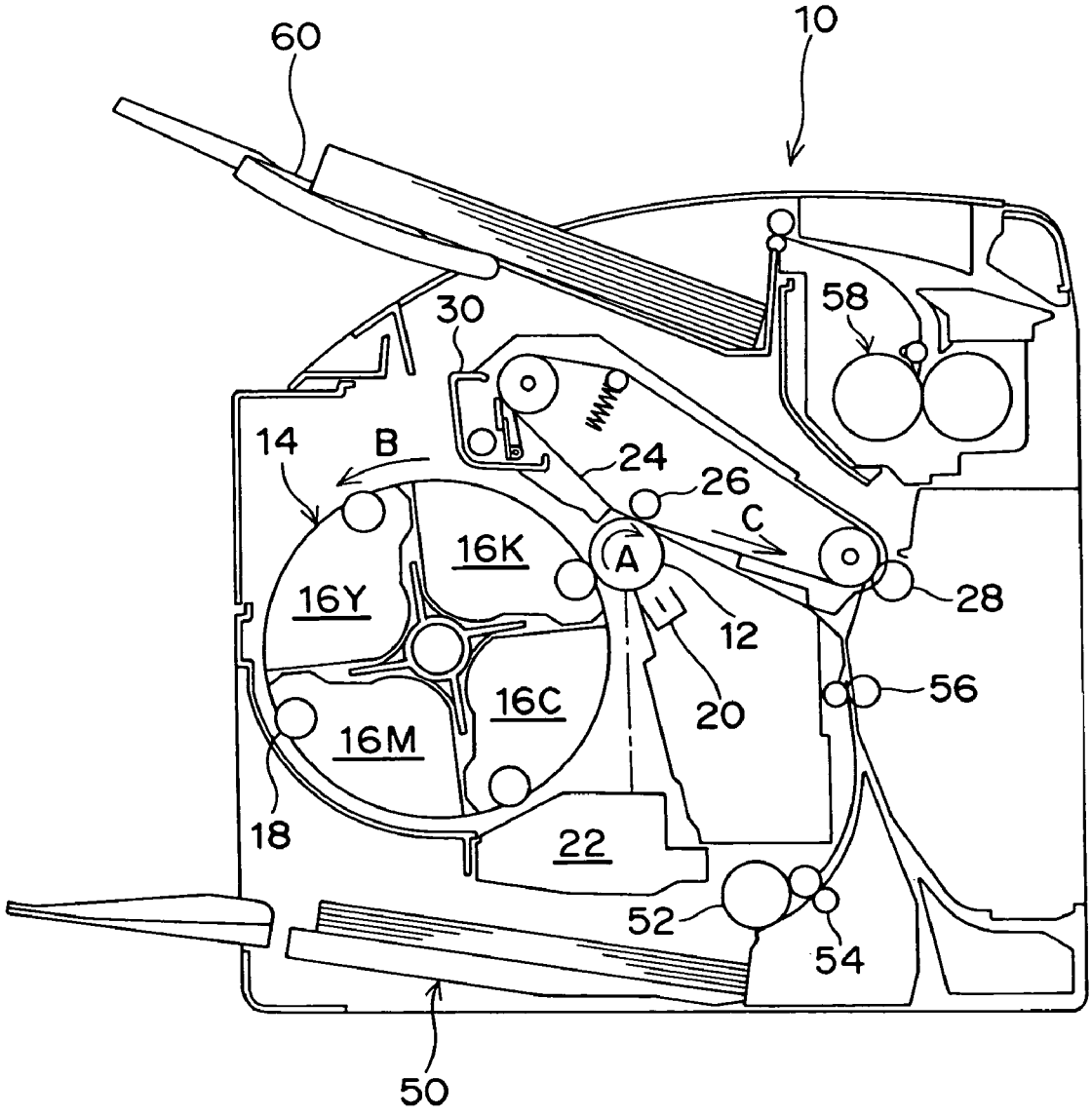
FIG. 1 is a schematic structure view showing an image forming apparatus having a cleaning device in one embodiment of the present invention.

FIG. 1 shows an overall schematic structure of an image forming apparatus 10 having a cleaning device 30 in one embodiment of the present invention. The image forming apparatus 10 has a roller-shaped photoreceptor rotationally driven in an arrow A direction in almost the center of the inside of the apparatus. Placed adjacent to the photoreceptor 12 is an almost column-shaped developing unit 14 which is rotationally driven in an arrow B direction.

The developing unit 14 is composed of four developing devices 16Y, 16M, 16C, 16K corresponding respectively to toner (developer) of yellow (Y), magenta (M), cyan (C) and black (K) colors, the developing devices being disposed evenly in circumferential direction around the developing unit 14. Each of the developing devices 16Y, 16M, 16C, 16K has a developing roller 18 for feeding the toner held on its outer circumferential face while rotating for developing an electrostatic latent image on the surface of the photoreceptor 12.

Moreover, disposed around the photoreceptor 12 are a charging device 20 for uniformly charging the surface of the photoreceptor 12, an exposure device 22 for exposing the uniformly charged surface of the photoreceptor 12 in conformity with image data so as to form an electrostatic latent image, and a primary transfer roller 26 for primarily transferring a toner image formed by developing the electrostatic latent image with the developing unit 14 from the photoreceptor 12 to an intermediate transfer belt (transfer body) 24. It is to be noted that without being limited to the belt shape, the transfer body may take other shapes (e.g., a roller shape).

The intermediate transfer belt 24, which is an endless belt like an endless sheet, is supported by four rollers including the primary transfer roller 26 disposed inside the belt and is rotationally driven in an arrow C direction in the state that specified tension is applied. Moreover, a secondary transfer roller 28 for secondarily transferring a toner image, which has been transferred onto the intermediate transfer belt 24, onto a paper sheet is placed on the outer peripheral face of the intermediate transfer belt 24 in the state of being in contact therewith. Further, a cleaning device 30 for removing undesired substances such as residual toner on the surface of the intermediate transfer belt 24 after the secondary transfer as well as paper powders and dust attached onto the surface is provided on the intermediate transfer belt 24 in a separatable way. Detailed description of the cleaning device 30 will be given later.

A paper feed section 50 for housing paper sheets that are recording media is provided on the lower side in the image forming apparatus 10. The paper sheets housed in the paper feed section 50 are sent out one by one by a paper feed roller 52. A paper sheet sent out from the paper feed section 50 is transported upward by a pair of transportation rollers 54, and is feed into between the intermediate transfer belt 24 and the secondary transfer roller 28 by a pair of timing rollers 56 in a specified timing that a toner image transferred onto the intermediate transfer belt 24 is transported to a position in contact with the secondary transfer roller 28.

Moreover, inside the image forming apparatus 10, a fixing device 58 is placed above the secondary transfer roller 28, and a paper discharge section 60 is provided in an upper part of the image forming apparatus 10. Further, on a main body of the image forming apparatus 10, a display section (unshown) formed from, for example, an LCD for displaying various information is placed.

It is to be noted that the image forming apparatus 10 may have a double-sided unit for allowing automatic image formation on both sides of a paper sheet, an additional paper feed cassette for housing a large number of or a wide variety of paper sheets, and a manual feeder mechanism.

Description is now given of image forming operation of the above-structured image forming apparatus 10.

The image forming apparatus 10 starts image forming operation upon reception of image data from a computer connected directly or via a network.

In the case where the image data is a color image, a yellow electrostatic latent image formed on the surface of the photoreceptor 12 by the exposure device 22 is first developed by the developing device 16Y to form a yellow toner image, and the yellow toner image is primarily transferred from the photoreceptor 12 onto the intermediate transfer belt 24. Next, in the same process, while the developing unit 14 is rotated, a magenta toner image, a cyan toner image and a black toner image are formed in succession and are primarily transferred in sequence to be superimposed on the yellow toner image having been transferred on the intermediate transfer belt 24. In this case, the intermediate transfer belt 24 is rotated at least four times, during which the cleaning device 30 is in the state away from the intermediate transfer belt 24, and therefore four color toner images are not scraped away by the cleaning device 30.

The toner images transferred in the state of being superimposed on the intermediate transfer belt 24 are transported by rotation of the intermediate transfer belt 24 to a position in contact with the secondary transfer roller 28. At this point, a paper sheet sent out from the paper feed section 50 by the paper feed roller 52 and transported upward by a pair of the transportation rollers 54 and a pair of the timing rollers 56 is fed into a contact section between the intermediate transfer belt 24 and the secondary transfer roller 28. As a result, the toner image on the intermediate transfer belt 24 is secondarily transferred onto the paper sheet due to an electrostatic action by the secondary transfer roller 28. Residual toner and undesired substances on the intermediate transfer belt 24 after the secondary transfer are removed by the cleaning device 30 which is in contact with the intermediate transfer belt 24.

Then, when the paper sheet with the toner image transferred thereupon passes the fixing device 58, in which the toner image is fixed by heat and pressure, and then the paper sheet is discharged to the paper discharge section 60.

In the case where the image data is a monochrome image (a black image in particular), a toner image is formed by using one developing device of corresponding color, and a monochrome image is attained by the same process as described above (i.e., primary transfer onto the intermediate transfer belt 24, secondary transfer from the intermediate transfer belt 24 to a paper sheet, fixation of a toner image and so on). In this case, the monochrome image primarily transferred onto the intermediate transfer belt 24 is secondarily transferred onto a paper sheet immediately, and therefore the intermediate transfer belt 24 should only be rotated one time and the cleaning device 30 should kept in contact with the intermediate transfer belt 24 without the necessity of being separated therefrom.

Detailed description is now given of the cleaning device 30.

Figure 2:
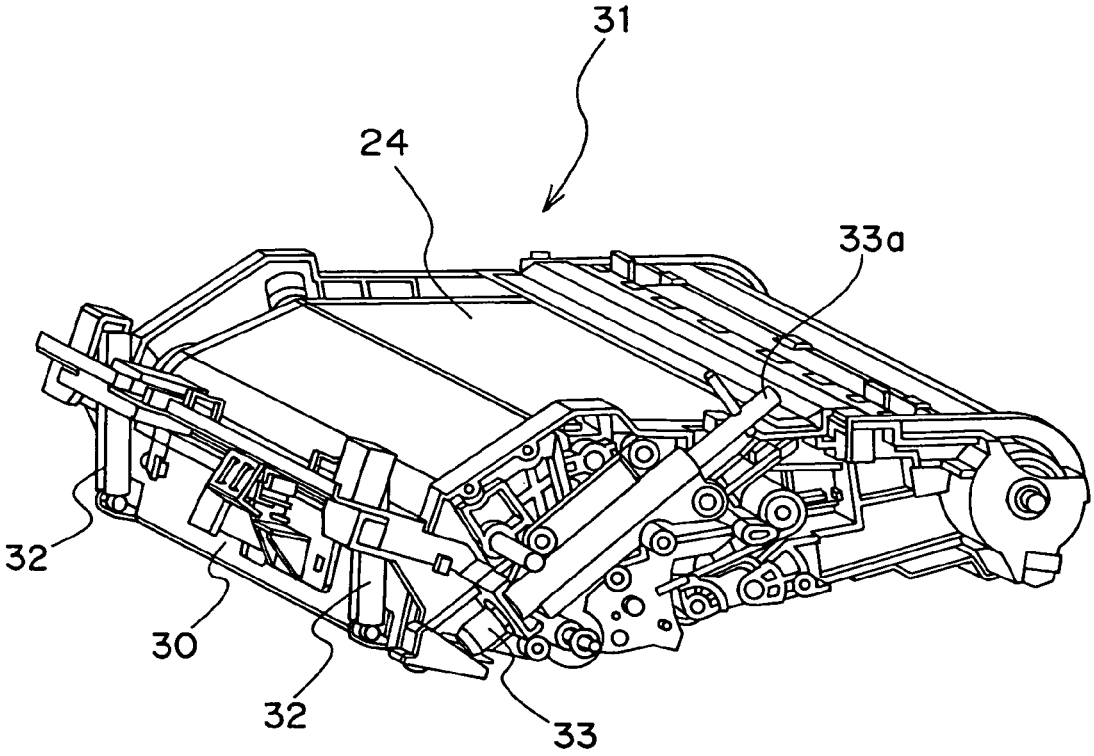
FIG. 2 is a perspective view showing an intermediate transfer unit structured so as to integrally include an intermediate transfer belt and a cleaning device.

FIG. 2 is an external perspective view showing an intermediate transfer unit 31 structured so as to integrally include the intermediate transfer belt 24 hung over four rollers and the cleaning device 30. The intermediate transfer unit 31 receives drive from the main body in the state of being mounted inside the main body of the image forming apparatus 10.

The cleaning device 30 is in pressure contact with the intermediate transfer belt 24 by a plurality of (two in this embodiment) tension coil springs 32. This is for pressing an unshown cleaning member in the cleaning device 30 toward the intermediate transfer belt 24 with constant pressure, and detail thereof will be described later.

Moreover, as described in the image forming operation, the cleaning device 30 needs to be able to move so as to be in pressure contact with and be separated from the intermediate transfer belt 24. During color image formation, the intermediate transfer belt 24 needs to be rotated four times so as to superimpose four color toner images, and in this operation, the cleaning member should be away from the intermediate transfer belt 24. At any other time, the cleaning member is in pressure contact with the intermediate transfer belt 24.

In consideration of the moving velocity of the intermediate transfer belt 24, the size of the image forming apparatus 10 and the length of the intermediate transfer belt 24 determined based on various image processes, the pressure contact/separation operation of the cleaning device 30 should be performed smoothly and swiftly. In the present embodiment, a reciprocating motion of a pressure contact/separation shaft 33 is converted to a rotational motion of the cleaning device 30 so as to perform the pressure contact/separation operation of the cleaning device 30. The reciprocating motion of the pressure contact/separation shaft 33 is controlled by a drive member on the main body side of the image forming apparatus 10. A coupling member (unshown) is mounted on an end section 33*a* of the pressure contact/separation shaft 33 opposite to an end section in contact with the cleaning device 30, and the coupling member and a drive member on the main body side are engaged and operated together in the state that the intermediate transfer unit 31 is mounted in the image forming apparatus 10.

Figure 3:
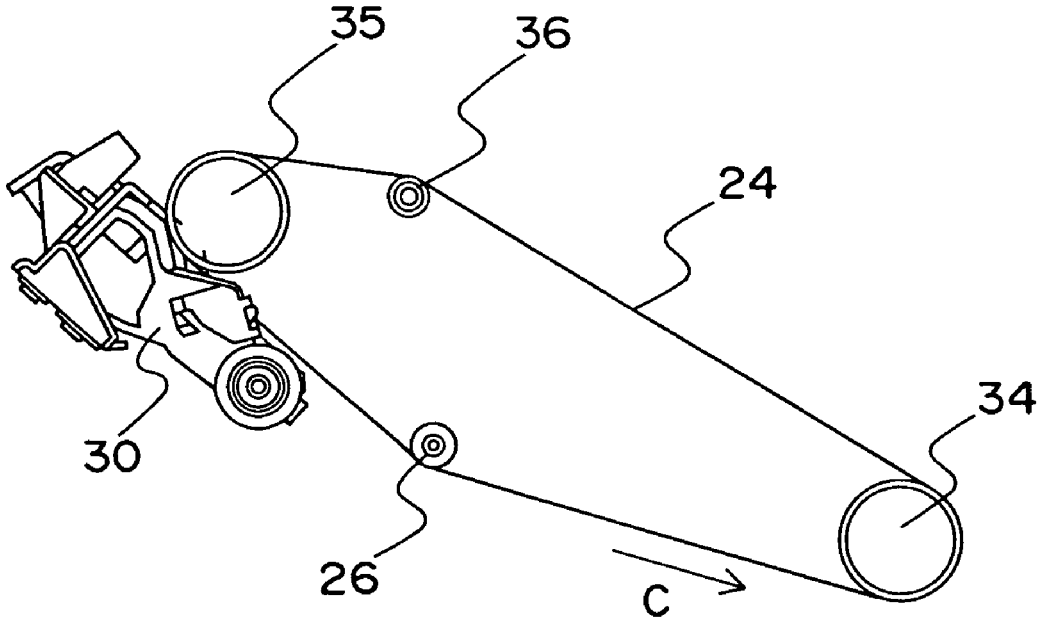
FIG. 3 is a side view showing a positional relation between the intermediate transfer belt and the cleaning device.

FIG. 3 is a side view showing a positional relation between the intermediate transfer belt 24 and the cleaning device 30 in FIG. 2. The intermediate transfer belt 24 moves in an arrow C direction by rotation of a drive roller 34. In order to determine the shape of the intermediate transfer belt 24, an opposition roller 35, a primary transfer roller 26 and a tension roller 36 for applying constant belt tension are disposed.

Figure 4:
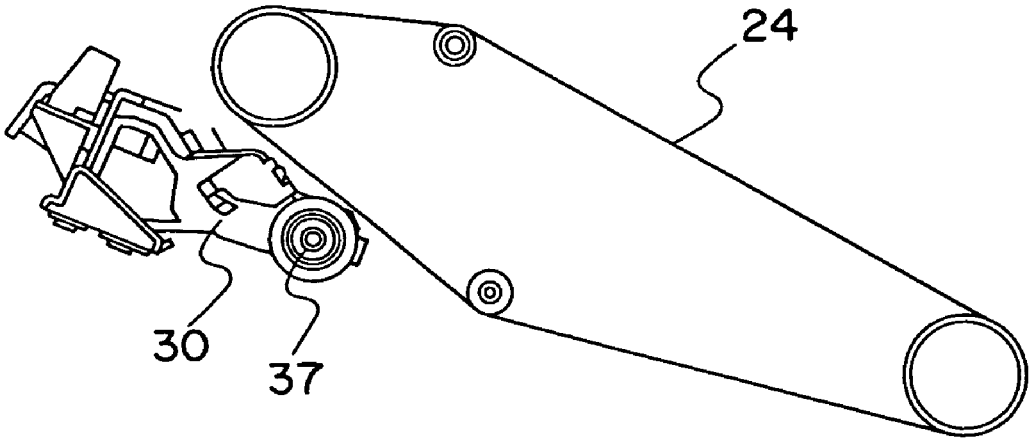
FIG. 4 is a view showing the cleaning device separated from the intermediate transfer belt.

FIG. 4 shows the state that the cleaning device 30 is separated from the intermediate transfer belt 24. The cleaning device 30 rotates counterclockwise around a rotation center 37 as a supporting point so that components in the cleaning device 30 are away from the intermediate transfer belt 24 by a constant distance.

Description is now given of the detailed structure and operation of the cleaning device 30 in comparison to a conventional cleaning device 30' with reference to FIG. 5A through FIG. 13.

Figure 5A:
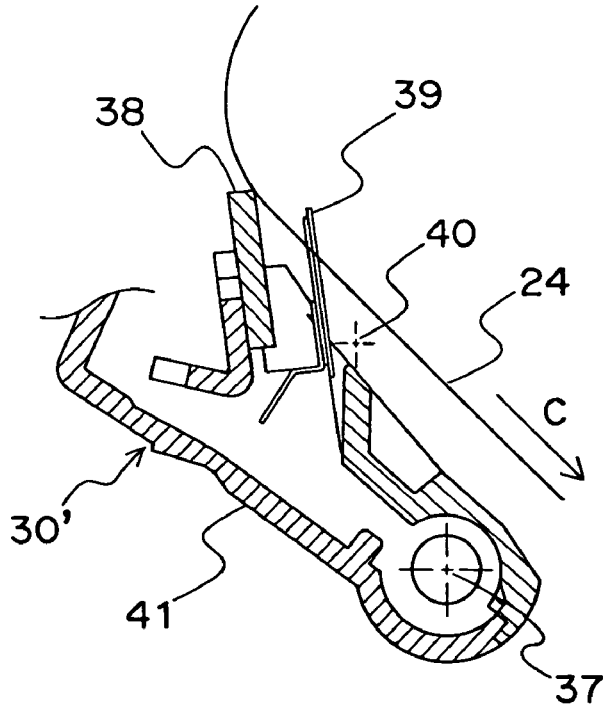
FIG. 5A is a view showing the structure of a conventional cleaning device.

FIG. 5A shows the state that the conventional cleaning device 30' is in pressure contact with the intermediate transfer belt 24. An arrow C represents a moving direction of the intermediate transfer belt 24. The cleaning device 30' is in pressure contact with the intermediate transfer belt 24 by tension coil springs 32 (see FIG. 2).

The cleaning device 30' has a first cleaning member 38 and a second cleaning member 39 placed downstream from the first cleaning member 38 with respect to the moving direction of the intermediate transfer belt 24. As the first cleaning member, a blade member made of, for example, an urethane rubber or metal is used. As the second cleaning member, for example, a urethane sheet bonded to a resin sheet is used. The second cleaning member 39 is placed in the state of being fixed so as not to be rotated at a specified position with respect to the first cleaning member 38. Moreover, the first cleaning member 38, which is rotatable around a supporting point 40, is pressed by the tension coil springs 32 (see FIG. 2) so as to keep pressure applied to the intermediate transfer belt 24 constant.

Figure 5B:
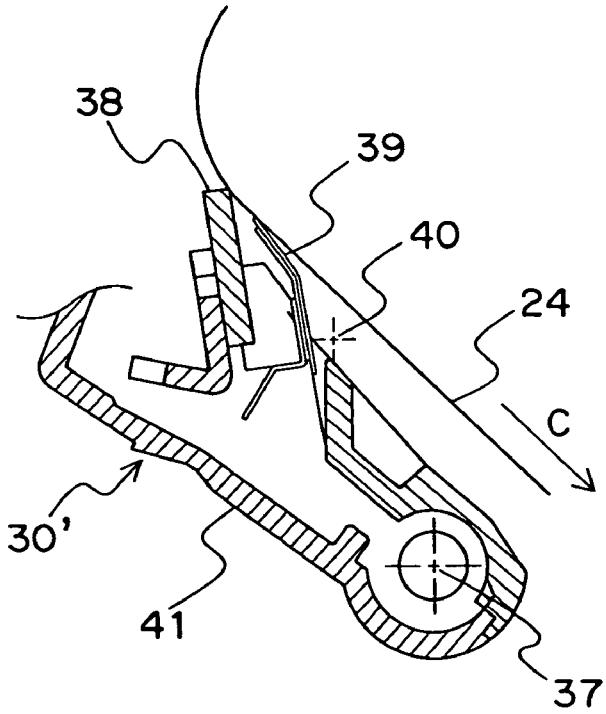
FIG. 5B is a view showing a second cleaning member in the conventional cleaning device deflected and deformed upon coming into contact with the intermediate transfer belt.

The cleaning device 30' shown in FIG. 5A is in a pressure contact state, i.e., under cleaning operation, and a top end section of the first cleaning member 38 is removing residual toner and the like on the intermediate transfer belt 24. The removed toner and the like are entered inside a housing 41 and is processed so that the removed toner and the like will not splatter out of the cleaning device 30. In this case, the second cleaning member does not particularly operate. While FIG. 5A shows that the second cleaning member 39 extends straight as with the state not in contact with the intermediate transfer belt 24 (hereinbelow referred to as "initial state"), the second cleaning member 39 in actuality is deflected and deformed upon coming into contact with the intermediate transfer belt 24 and being pressed thereby. That state is shown in FIG. 5B. Since the cleaning device 30' is often retained in the state shown in FIG. 5B, out of concern of the creep deformation, a thin sheet type member less prone to creep deformation is used as the second cleaning member 39.

Figure 6A:
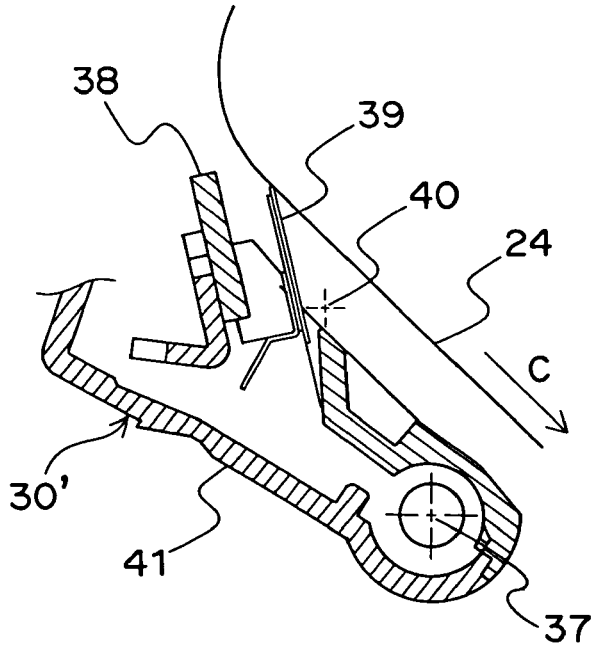
FIG. 6A is a view showing the state immediately after the conventional cleaning device starts to be separated from the intermediate transfer belt and before the second cleaning member is creep-deformed.

FIG. 6A shows the state that the conventional cleaning device 30' has been finished cleaning and the cleaning device 30' starts to be separated from the intermediate transfer belt 24. Immediately after the first cleaning member 38 is separated from the intermediate transfer belt 24, the second cleaning member 39 is still in contact with the intermediate transfer belt 24, and therefore a so-called separation streak, which are a streak formed by residual toner and the like having been already collected when the first cleaning member 38 is separated, can be removed by the second cleaning member 39. The second cleaning member 39 also plays a role of removing not only the separation streak but also all the residual toner that the first cleaning member 38 has failed to scrape. An electricity removal seal member is sometimes provided in the vicinity of the upstream side of the first cleaning member 38, and in the case where the first cleaning member 38 fails to remove the separation streak of the seal member, the second cleaning member 39 is to remove it.

FIG. 6A shows that the second cleaning member 39 is in the initial state so that its top end section is lightly in pressure contact with the intermediate transfer belt 24 without suffering deflection and deformation. When the second cleaning member 39 is left in the state shown in FIG. 5B for a longer period of time, the second cleaning member 39 suffers creep deformation.

Figure 6B:
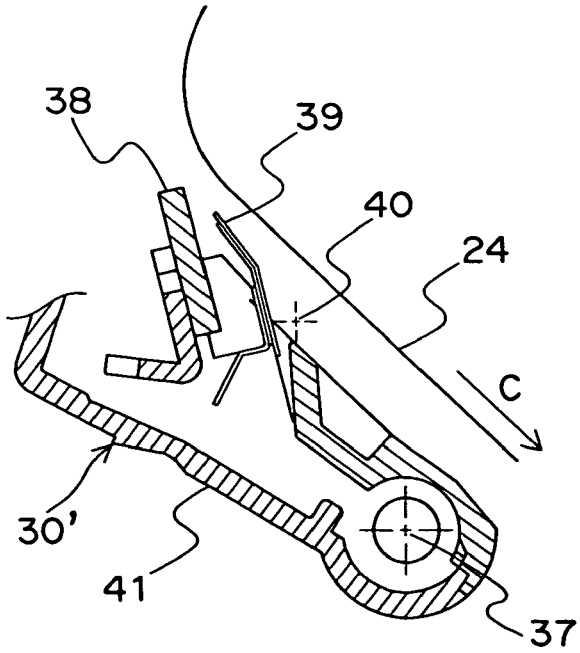
FIG. 6B is a view showing the state immediately after the conventional cleaning device starts to be separated from the intermediate transfer belt and after the second cleaning member has been creep-deformed.

FIG. 6B shows an example of the case where the second cleaning member 39 suffers creep deformation. Although the second cleaning member 39 should essentially be pressed toward the intermediate transfer belt 24 to remove the separation streak of the first cleaning member 38, progress of the creep deformation causes the second cleaning member 39 to be separated from the intermediate transfer belt 24 almost concurrently with the first cleaning member 38.

The second cleaning member 39 is aligned with the first cleaning member 38 in a certain standard value range and fixed. The standard value is determined in consideration of a moving velocity of the intermediate transfer belt 24 and a moving (rotation) velocity of the cleaning device 30' so that the second cleaning member 39 can remove the separation streak generated when the first cleaning member 38 is separated from the intermediate transfer belt 24. Therefore, once the creep deformation of the second cleaning member 39 has progressed beyond a certain degree, the separation streak of the first cleaning member 38 cannot be removed. Toner and the like that constitute the unremoved separation streak are likely to fall during movement of the intermediate transfer belt 24, and may soil the inside of the image forming apparatus 10 or may be reattached to other positions of the intermediate transfer belt 24 and be transferred onto a paper sheet, resulting in degradation of image quality.

It may be considered to allow a sufficient length for the second cleaning member 39 so that the separation streak can be removed even with creep deformation of the second cleaning member 39. In this case, however, the cleaning device 30' grows in size, and this contradicts downsizing of the image forming apparatus 10.

Figure 7A:
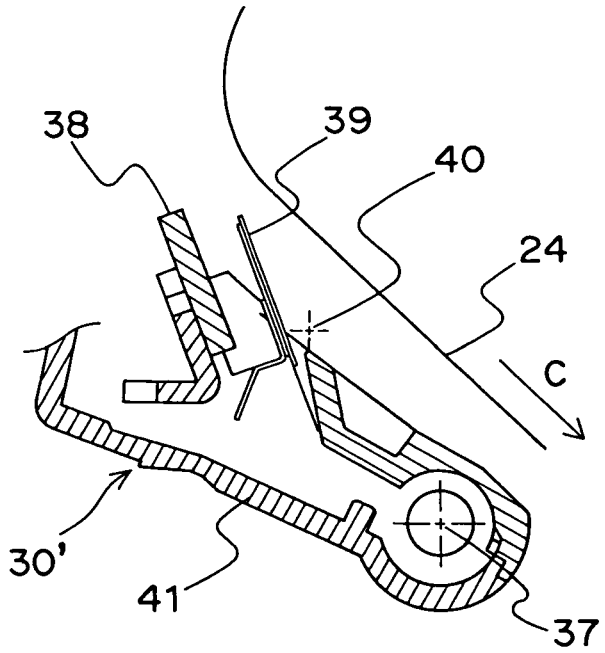
FIG. 7A is a view showing the state that the conventional cleaning device is completely separated from the intermediate transfer belt and before the second cleaning member is creep-deformed.
Figure 7B:
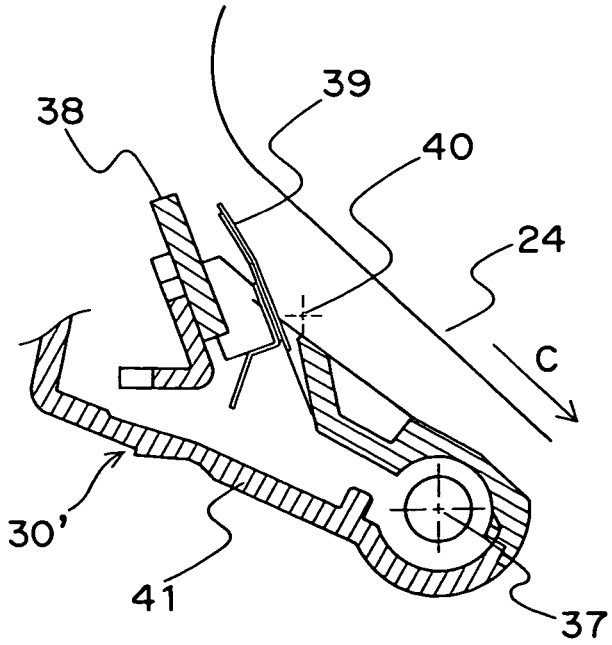
FIG. 7B is a view showing the state that the conventional cleaning device is completely separated from the intermediate transfer belt and after the second cleaning member has been creep-deformed.

FIGS. 7A and 7B show the state that the cleaning device 30' is completely separated from the intermediate transfer belt 24. FIG. 7A shows an example in which the second cleaning member 39 is in the initial state, while FIG. 7B shows an example in which the second cleaning member 39 suffers creep deformation. The removed toner is attached to the first cleaning member 38 and the second cleaning member 39, and separating these members from the intermediate transfer belt 24 by a specified distance prevents the toner from splattering.

Figure 8:
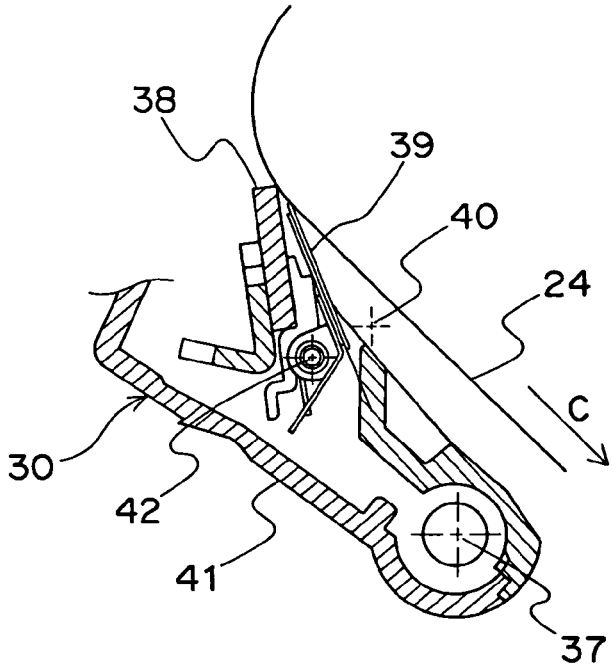
FIG. 8 is a view showing a cleaning device in one embodiment of the present invention.

FIG. 8 shows the state that the cleaning device 30 in the present embodiment is in pressure contact with the intermediate transfer belt 24. As with the above-stated cleaning device 30', the cleaning device 30 also has a first cleaning member 38 and a second cleaning member 39 placed downstream from the first cleaning member 38 with respect to the moving direction of the intermediate transfer belt 24, though the cleaning device 30 is different from the cleaning device 30' in the point that the second cleaning member 39 is provided rotatably with respect to the first cleaning member 38.

The second cleaning member 39 is rotatable around a rotation center 42 as a supporting point. The rotation center 42 may be positioned with respect to the first cleaning member 38 or the housing 41.

In the case where the second cleaning member 39 is positioned with respect to the first cleaning member 38, it becomes relatively easy to secure a positional relation therebetween during assembling process. In this case, it is necessary to secure a space to mount the second cleaning member 39 in a part of the components supporting the first cleaning member 38. Moreover, the first cleaning member 38 is slightly influenced by elastic deformation due to pressure contact of the first cleaning member 38 with the intermediate transfer belt 24. In the case where the positional displacement of the rotation center 42 or an inclination of a support shaft including the rotation center 42 are generated because of the elastic deformation, assembling operation should be performed on the assumption that the elastic deformation would occur.

In the case where the second cleaning member 39 is positioned with respect to the housing 41, it is necessary to secure a positional relation between the first cleaning member 38 and the second cleaning member 39 on the housing 41 side. Since both the members are separately mounted on the housing 41, it becomes necessary to secure assembling accuracy based on component accuracy, to employ a structure allowing assembling with use of jigs and to provide a mechanism allowing position adjustment. Once the positioning and assembly are completed, an influence of bringing the first cleaning member 38 into pressure contact with the intermediate transfer belt 24 is eliminated and therefore it is unnecessary to concern this point during assembling process.

In the case where the second cleaning member 39 is not positioned with respect to the first cleaning member 38 and the housing 41, a plurality of members are to be interposed and this makes it difficult to secure the positional relation between these members. If the positional relation is not secured, then an advantage obtained by making the second cleaning member 39 rotatable cannot be fully utilized.

As with the above-stated conventional cleaning device 30', the entire cleaning device 30 is biased toward the intermediate transfer belt 24 by tension coil springs 32 (see FIG. 2), and the intermediate transfer belt 24 moves in an arrow C direction. The first cleaning member 38, which is rotatable around a supporting point 40, is pressed by the tension coil springs 32 so as to keep pressure applied to the intermediate transfer belt 24 constant.

The cleaning device 30 shown in FIG. 8 is in a pressure contact state, i.e., under cleaning operation, and a top end section of the first cleaning member 38 is removing residual toner and the like on the intermediate transfer belt 24. The removed toner and the like are entered inside the housing 41 and is processed so that the removed toner and the like will not splatter out of the cleaning device 30. In this case, the top end of the second cleaning member 39 is lightly in pressure contact with the intermediate transfer belt 24.

Figure 9A:
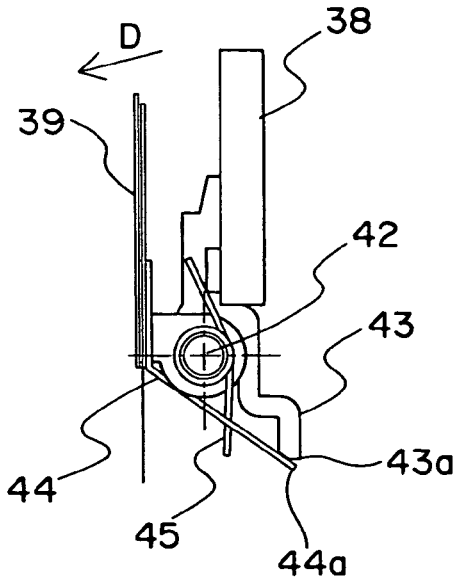
FIG. 9A is a side view showing a rotation and pressing mechanism of a second cleaning member in the cleaning device.
Figure 9B:
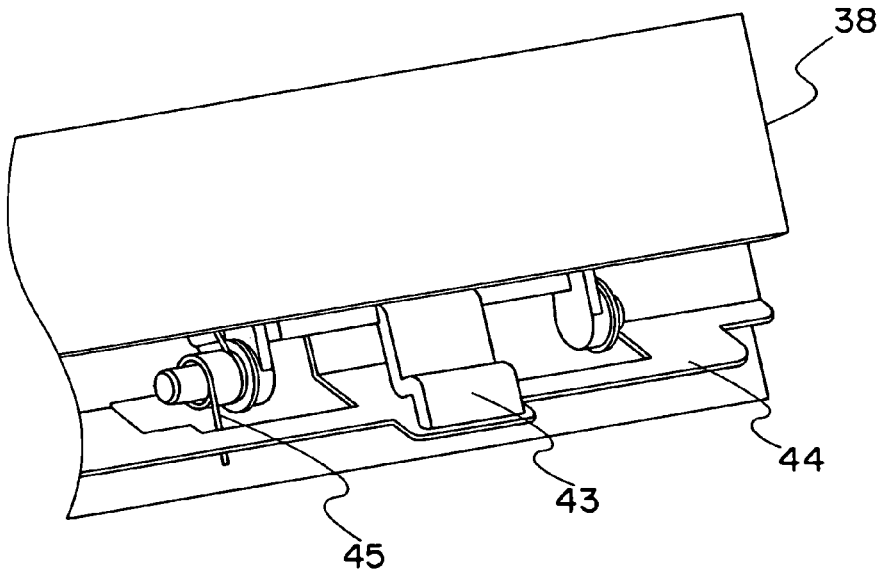
FIG. 9B is a perspective view showing the rotation and pressing mechanism of the second cleaning member in the cleaning device.
Figure 9C:
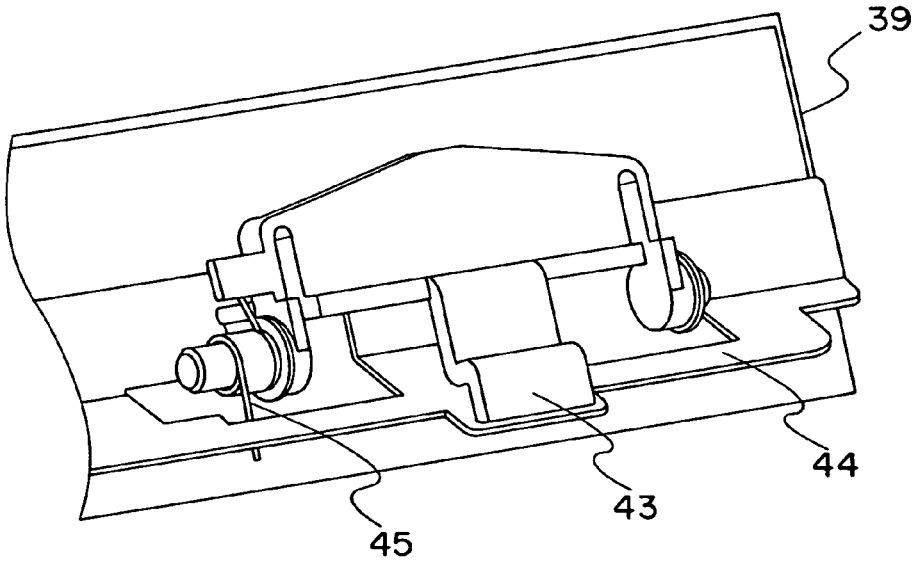
FIG. 9C is a perspective view of the rotation and pressing mechanism of the second cleaning member in the cleaning device shown with a first cleaning member being omitted.

FIGS. 9A to 9C shows a pressing mechanism for bringing the second cleaning member 39 into pressure contact with the intermediate transfer belt 24, and FIG. 9A is a view of the pressing mechanism seen from the opposite direction of FIG. 8. A mounting member 43 of the second cleaning member 39 is bonded and fixed to the first cleaning member 38. The second cleaning member 39 is bonded and fixed to a support member 44. The support member 44 is rotatably supported by the mounting member 43 at the position of the rotation center 42. This makes the second cleaning member 39 rotatable with respect to the first cleaning member 38. Moreover, the second cleaning member 39 is rotatable in the range free from generation of creep deformation when the first cleaning member 38 is brought into pressure contact with the intermediate transfer belt 24. "The range free from generation of creep deformation" herein refers to a rotation range including a position at which stress applied to the top end of the second cleaning member 39 in a bending direction is equal to or less than a limit value for preventing creep deformation of the second cleaning member 39. The "limit value" may herein be attained by following process. The stress in the bending direction is applied to the top end of the second cleaning member 39, and the second cleaning member 39 is left under a temperature condition of 35° C. for 100 hours. Consequently, when the stress is removed from the second cleaning member 39, such deformation that the direction of the top end section of the second cleaning member 39 bends approx 5 degrees from the initial state (i.e., such deformation that a variation in the bending direction of the top end position of the second cleaning member 39 is approx. 9% of a free length of the second cleaning member 39) is caused. The stress value when such deformation remains may be referred to as the limit value. In other words, if the variation under this condition is less than 5 degrees, then the stress in this case is within the level free from generation of creep deformation of the second cleaning member 39, and the rotation position of the second cleaning member 39 exposed to such stress is in "the range free from generation of creep deformation" (provided that numerical values used herein are only one example and that the present embodiment is not limited to these numerical values).

By setting torsion coil springs 45 around the support shaft including the rotation center 42, the second cleaning member 39 is biased toward an arrow D direction (i.e., toward the intermediate transfer belt 24). While the position of the top end of the second cleaning member 39 is regulated by the intermediate transfer belt 24, a rotation regulation member is necessary in order to secure a specified position in the state that the cleaning device 30 is separated from the intermediate transfer belt 24 and the second cleaning member 39 is free from regulation by the intermediate transfer belt 24. In this embodiment, the mounting member 43 also serves as the rotation regulation member. More particularly, by bringing an end section 43*a* of the mounting member 43 into contact with an extension section 44*a* of the support member 44 for the second cleaning member 39, rotation of the second cleaning member 39 is regulated in the state that the second cleaning member 39 is almost parallel to the first cleaning member 38.

FIGS. 9B and 9C are perspective views showing the structure shown in FIG. 9A, and FIG. 9C shows the structure with the first cleaning member 38 removed. A support section for supporting the second cleaning member 39 rotatably with respect to the first cleaning member 38 is provided in two positions in the longitudinal direction of the second cleaning member 39. This is for uniformly applying biasing power by a spring 45 and for securing a large distance between supporting points to secure positional accuracy. It is to be noted that the support section may be provided in three or more positions in consideration of deformation in the longitudinal direction of the second cleaning member 39 or for the purpose of changing the way the biasing force is applied.

If the biasing force by the torsion coil springs 45 is excessively large, then a sufficient advantage cannot be implemented even with the rotatable structure of the second cleaning member 39 due to deflection and deformation as with the conventional cleaning device 30'. Although biasing force equal to or less than the limit quantity for preventing creep deformation of the second cleaning member 39 is applied in the present embodiment, creep deformation may be allowed to some degree if there is some structural allowance. Herein "the limit quantity for preventing creep deformation" refers to biasing force which causes the stress of the limit value as described above to be applied to the top end of the second cleaning member 39. In determining the biasing force of the torsion coil spring 45, sufficient results may be expected by setting the limit quantity to be equal to or lower than a stress limit for creep deformation in consideration of a stress value applied to the second cleaning member 39.

Figure 10A:
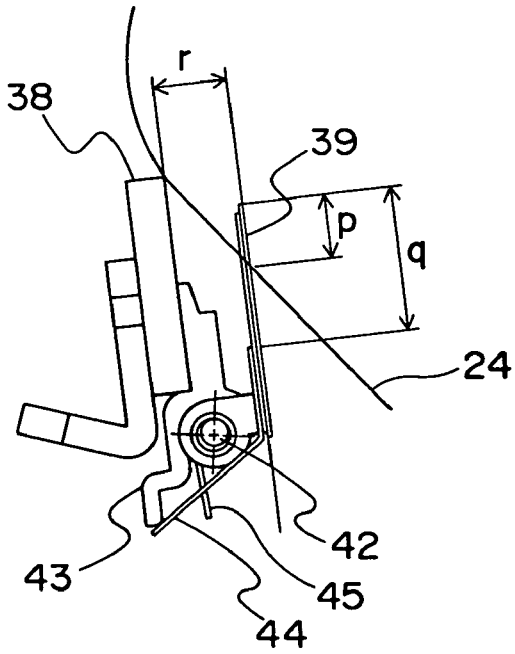
FIG. 10A is a view showing an example of a size of each cleaning member in the cleaning device.
Figure 10B:
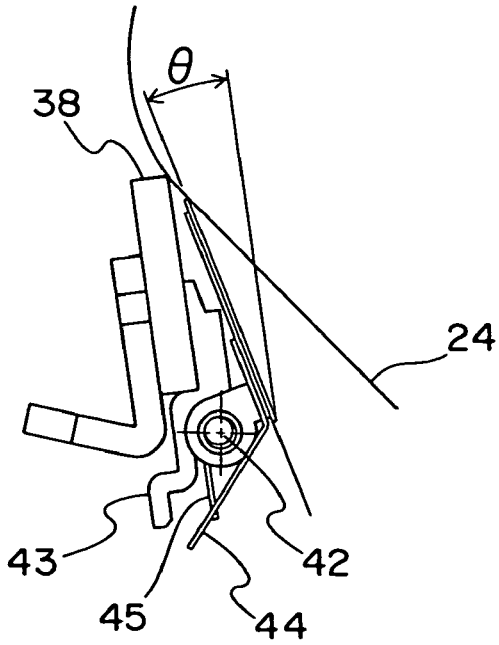
FIG. 10B is a view showing an example of a rotation angle of the second cleaning member in the cleaning device.

FIGS. 10A and 10B show one example of a size of each section. In FIG. 10A, the second cleaning member 39 opened to a rotation regulation position is overlapped with the intermediate transfer belt 24. A reference character "r" represents a distance between top ends of the first cleaning member 38 and the second cleaning member 39, a reference character "q" represents a free length of the second cleaning member 39 and a reference character "p" represents an overlapping margin of the second cleaning member 39 and the intermediate transfer belt 24. FIG. 10B shows the rotating state of the second cleaning member 39 with a rotation angle "θ" made when the second cleaning member 39 in the state shown in FIG. 10A rotates till its top end comes into contact with the intermediate transfer belt 24 without deflection and deformation. In the present embodiment, an urethane sheet with a thickness of 150 μm bonded to a PPS sheet with a thickness of 50 μm was used as the second cleaning member 39 with the setting of r=4 mm. p=3.7 mm, q=8 mm, θ=14° and biasing force by the torsion coil springs 45 being 0.2N, by which the creep deformation of the second cleaning member 39 could be prevented.

Figure 11:
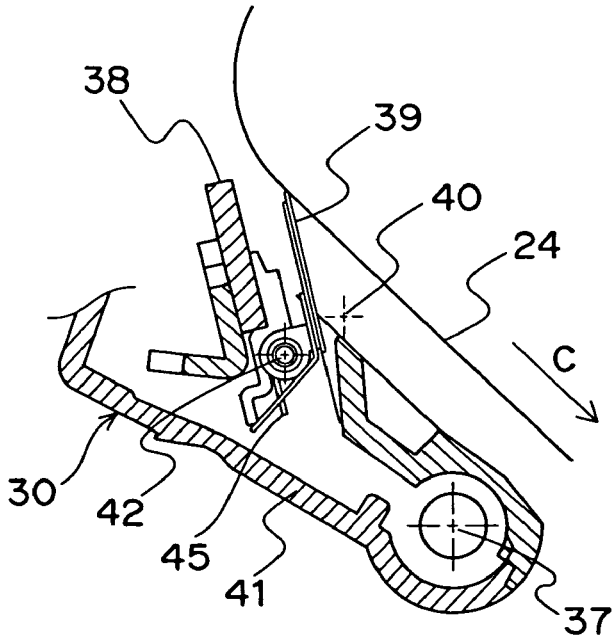
FIG. 11 is a view showing the state immediately after the cleaning device starts to be separated from the intermediate transfer belt.

FIG. 11 shows the state that the cleaning device 30 which has finished cleaning starts to be separated from the intermediate transfer belt 24 by rotating around a rotation center 37. Immediately after the first cleaning member 38 is separated from the intermediate transfer belt 24, the second cleaning member 39 is still in pressure contact with the intermediate transfer belt 24 so that the separation streak left on the intermediate transfer belt 24 when the first cleaning member 38 is separated are removed by the second cleaning member 39.

Upon separation of the cleaning device 30, the second cleaning member 39 rotates with the rotation center 42 as a supporting point by biasing force by the torsion coil springs 45. However, till the second cleaning member 39 reaches a rotation regulation position (i.e., a position at which the end section of the mounting member 43 comes into contact with the extension section 44*a* of the support member 44 as shown in FIG. 9A), the top end of the second cleaning member 39 keeps on being in pressure contact with the intermediate transfer belt 24. Once the second cleaning member 39 has rotated to the rotation regulation position, the second cleaning member 39 is separated from the intermediate transfer belt 24 as the cleaning device 30 is separated therefrom.

Biasing force by the torsion coil springs 45, which acts upon the rotation of the second cleaning member 39, should be enough to offer smooth rotation. In order to supply the biasing force capable of offering smooth rotation while preventing deformation of the second cleaning member 39 in the state shown in FIG. 8, it is necessary to set the biasing force at a value close to a limit for preventing creep deformation and to decrease rotation resistance of the support member 44 onto which the second cleaning member 39 is fixed.

Toner and the like removed by the second cleaning member 39 in FIG. 11 falls between the second cleaning member 39 and the first cleaning member 38 so as to be housed in the housing 41 and processed to prevent their spattering. In this operation, if it is concerned that the removed toner and the like are attached to the vicinity of the support shaft including the rotation center 42 to cause increased rotation resistance of the second cleaning member 39 or the toner and the like are fixed thereon to cause rotation failure, it is necessary to take a means to prevent attachment of the toner and the like thereto.

One example of the means is to displace the position of the rotation center 42 in direction vertical to the page of FIG. 11 or to coat the area around the rotation center 42 with a cover. Moreover, performing pressure contact/separation operation of the cleaning device 30 at power-on or with specified timing (e.g., upon the elapse of specified time after completion of image formation, and upon recovery of the image forming apparatus 10 from a sleep mode) is an effective means to prevent fixation of the second cleaning member 39 onto the rotation center 42.

Figure 12:
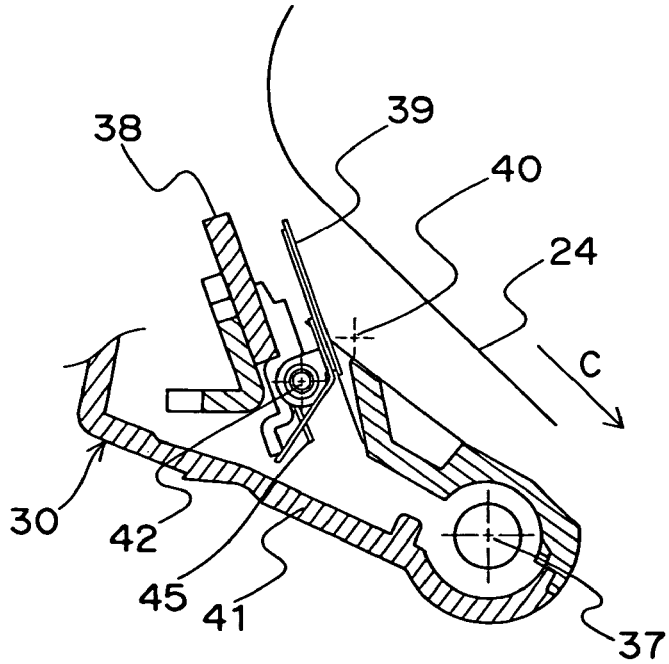
FIG. 12 is a view showing the state that the cleaning device is completely separated from the intermediate transfer belt.

FIG. 12 shows the state that the cleaning device 30 is completely separated from the intermediate transfer belt 24. This state is similar to the initial state of the second cleaning member 39 in the conventional cleaning device 30' shown in FIG. 7A. The removed toner and the like are attached to the first cleaning member 38 and the second cleaning member 39, and therefore the first cleaning member 38 and the second cleaning member 39 are put away from the intermediate transfer belt 24 by a specified distance so as to prevent the toner and the like from spattering.

Next, with reference to FIG. 13, description will be given of the relation among a moving velocity "V" of the intermediate transfer belt 24, a time lag "t" between time when the first cleaning member 38 is away from the intermediate transfer belt 24 and time when the second cleaning member 39 is away from the intermediate transfer belt 24, and a distance "L" between top ends of the first cleaning member 38 and the second cleaning member 39 on the intermediate transfer belt 24 when the top ends are away from the intermediate transfer belt 24.

Figure 13:
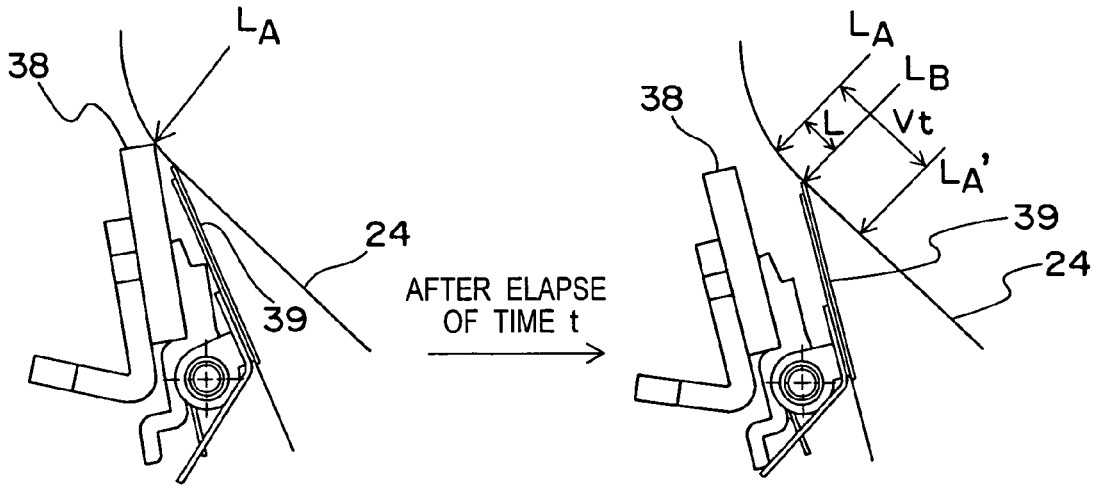
FIG. 13 is a view showing a positional relation when each cleaning member of the cleaning device is away from the intermediate transfer belt.

FIG. 13 shows the state shown in FIG. 8 being shifted to the state shown in FIG. 11. Reference character "$L_A$" represents a position of the top end of the first cleaning member 38 on the intermediate transfer belt 24 at the point of time when the top end is away from the intermediate transfer belt 24, reference character "$L_B$" represents a position of the top end of the second cleaning member 39 on the intermediate transfer belt 24 at the point of time when the top end is away from the intermediate transfer belt 24. Since the intermediate transfer belt 24 moves at the velocity V, the position $L_A$ of the first cleaning member 38 which moves away from the intermediate transfer belt 24 by a distance Vt during the elapse of time t reaches a position denoted by reference character "$L_A$'". The reference character L represents a distance between $L_A$ and $L_B$. Consequently, during the elapse of the time lag t between time when the first cleaning member 38 is away from the intermediate transfer belt 24 and time when the second cleaning member 39 is away from the intermediate transfer belt 24, the separation streak caused by the first cleaning member 38 moves by the distance Vt.

In order to remove the separation streak by the second cleaning member 39, $L<Vt$ should be satisfied. In the case of $L=Vt$, in the instant when the separation streak reaches the top end position of the second cleaning member 39, the second cleaning member 39 is away from the intermediate transfer belt 24, and this makes it impossible to remove the separation streak.

In a contact section between the first cleaning member 38 and the intermediate transfer belt 24, elastic deformation is generated depending on the respective materials and thicknesses. As a result, the separation streak generated at the time of separation of the first cleaning member 38 has a certain width. When a contact width of the first cleaning member 38 and the intermediate transfer belt 24 is assumed to be "b", a width of the separation streak can be considered roughly as "b". Moreover, with an allowance being "α" in consideration of a larger width of the separation streak or variations in components including the first cleaning member 38 and the second cleaning member 39, a relation $L+b+\alpha \leqq Vt$ should be satisfied. Since the creep deformation of the second cleaning member 39 can be neglected in the present embodiment, it becomes possible to decrease the value α to a negligible level compared to the conventional cleaning device 30'. Therefore, the limitations of the range of the distance L is decreased and freedom in layout and shape of components of the cleaning device 30 is increased proportionally.

In one example in the present embodiment, setting of V=127 mm/sec, t=75 msec, b=3 mm, L=1.5 mm made it possible to secure satisfactory cleaning performance.

While the separation streak caused by the first cleaning member 38 has been described as a main removal target, if an electricity removal seal member is provided on the upstream side of the first cleaning member 38 and the first cleaning member 38 fails to remove the separation streak caused by the electricity removal seal member, then the separation streak should also be removed by the second cleaning member 39. In the case where the removal target includes these residual toner streak and the like, it is necessary to attain the values $L_A$, $L_B$, $L_A'$, b and L depending on each target and to satisfy the above-stated relation.

Figure 14:
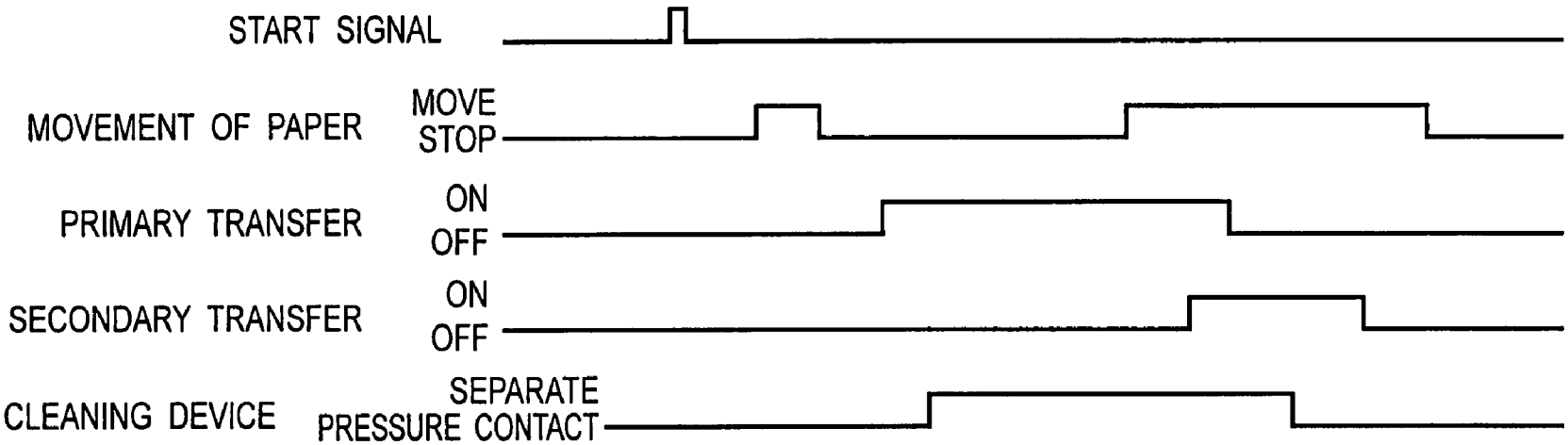
FIG. 14 is a timing chart of an image forming apparatus having the cleaning device in one embodiment of the present invention.

FIG. 14 is a timing chart (for color print) for an image forming apparatus 10 having the cleaning device 30 in the present embodiment. Since the image formation process has already been described, the pressure contact/separation timing of the cleaning device 30 will be described in particular. Upon reception of a print start signal, a paper sheet is transported to a pair of the timing rollers 56 before the secondary transfer roller 28. The image forming operation starts almost concurrently with the paper sheet transporting operation. In slight arrear of the start of primary-transfer for transferring a toner image from the photoreceptor 12 onto the intermediate transfer belt 24, the cleaning device 30 is separated from the intermediate transfer belt 24. The separation timing of the cleaning device 30 from the intermediate transfer belt 24 is determined such that residual toner by previous printing operation is removed and adverse effect is not exerted on a current printing target image.

While four toner images are superimposed in sequence on the intermediate transfer belt 24, the cleaning device 30 is kept in a separated state. With timing of the start of the primary transfer of the fourth color toner image, a paper sheet transportation by a pair of the timing rollers 56 is started and secondary transfer by the secondary transfer roller 28 is started. In slight arrear of the secondary transfer, the cleaning device 30 is brought into pressure contact with the intermediate transfer belt 24, and residual toner and the like are scraped and removed. When all the secondary transfer operations are finished and the paper sheet is discharged to the paper discharge section 60, a series of print operations are completed. In the case of monochrome printing, the cleaning device 30 is constantly kept in pressure contact with the intermediate transfer belt 24. That is because the secondary transfer is performed immediately after the primary transfer.

Figure 15:
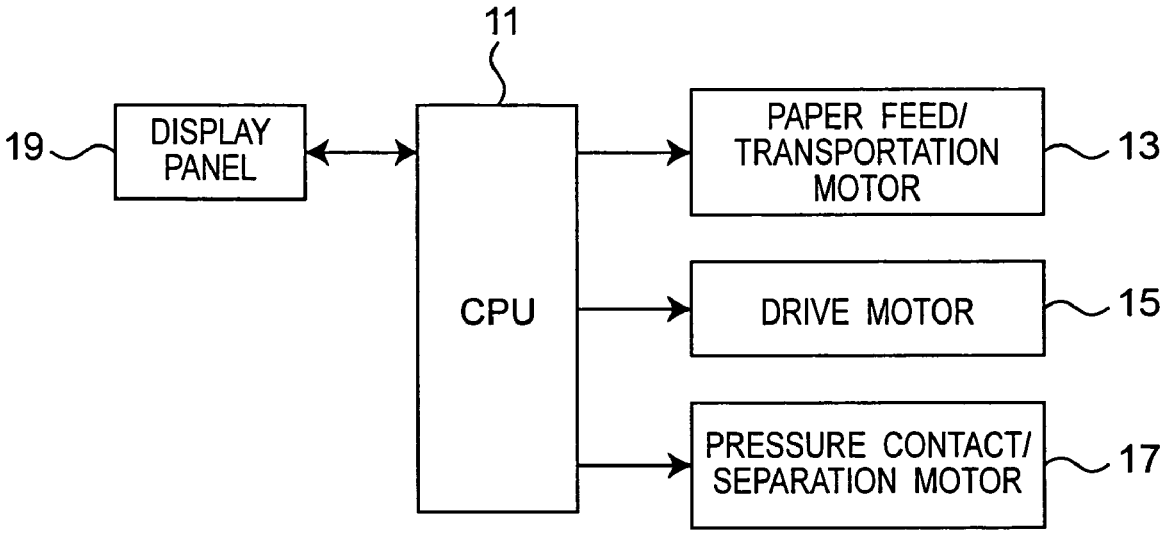
FIG. 15 is a block diagram showing the image forming apparatus having the cleaning device in one embodiment of the present invention.

FIG. 15 is a schematic block diagram showing the image forming apparatus 10 having the cleaning device 30 in the present embodiment. Upon reception of a print start signal from a personal computer and the like, a CPU 11 constituting a control section drives a paper feed/transportation motor 13 to transport a paper sheet, and transmits a signal to a drive motor 15 to drive the photoreceptor 12 and the intermediate transfer belt 24. Moreover, the pressure contact/separation operation of the cleaning device 30 is controlled by a pressure contact/separation motor 17. While stepping motors are generally used as these motors and open loop control by pulse control is often employed, the states of respective driven members may be detected by unshown sensors where necessary. Moreover, the state of the image forming apparatus 10 is displayed on a display panel 19 constituting the display section.

Although the present invention has been fully described by way of examples with reference to the accompanying drawings, it is to be noted that various changes and modifications will be apparent to those skilled in the art. Therefore, unless otherwise such changes and modifications depart from the spirit and the scope of the present invention, they should be construed as being included therein.

What is claimed is:

1. A cleaning device for cleaning a transfer body in an image forming apparatus, comprising:

a cleaning blade having a first end that is brought into pressure contact with the transfer body; and a cleaning member which is placed downstream from the cleaning blade with respect to a moving direction of the transfer body and having a first end that is brought into pressure contact with the transfer body, a support for the cleaning member, the cleaning member support holding a second end of the cleaning member, wherein the second end is distal from the transfer body, the support for the cleaning member being pivotable about a rotation point, wherein the support for the cleaning member is rotatably biased away from the cleaning blade and toward the transfer body, wherein the support for the cleaning member is mounted on the cleaning blade, wherein the cleaning blade is supported for rotation about a supporting point so that the cleaning blade moves together with the cleaning member to and from the transfer body, and wherein the cleaning blade and the cleaning member are biased toward the transfer body about the supporting point.

2. The cleaning device according to claim 1, wherein a rotation center of the cleaning member is positioned with respect to the cleaning blade.

3. The cleaning device according to claim 1, wherein a rotation center of the cleaning member is positioned on a housing of the cleaning device.

4. The cleaning device according to claim 1, wherein the cleaning member can rotate with respect to the cleaning blade in a range free from generation of creep deformation when the first end is brought into pressure contact with the transfer body.

5. The cleaning device according to claim 1, wherein the biasing force applied to the cleaning member is equal to or less than a limit quantity for preventing creep deformation of the cleaning member.

6. The cleaning device according to claim 1, wherein a rotation center of the cleaning member is placed in a position free from attachment of a developer or undesired substances removed by the cleaning blade or the cleaning member.

7. The cleaning device according to claim 1, wherein, in a cleaning state, the cleaning blade and the cleaning member are in pressure contact with the transfer body, and in a non-cleaning state the cleaning blade and the cleaning member are away from the transfer body, wherein the cleaning member is provided to be away from the transfer body in arrear from separation of the cleaning blade when the cleaning state is shifted to the non-cleaning state.

8. The cleaning device according to claim 1, wherein the cleaning member is biased so that the first end of the cleaning member is urged away from the first end of the cleaning blade.

9. The cleaning device according to claim 8, wherein the cleaning member pivots about a second end of the cleaning member.

10. The cleaning device according to claim 1, wherein the first end of the cleaning blade is the most upstream end of the cleaning blade with respect to the moving direction of the transfer body.

11. A cleaning device for cleaning a transfer body in an image forming apparatus, comprising:

a first cleaning member whose top end is brought into pressure contact with the transfer body; and a second cleaning member which is placed downstream from the first cleaning member with respect to a moving direction of the transfer body and whose top end is brought into pressure contact with the transfer body, wherein the second cleaning member is provided rotatably with respect to the first cleaning member, the cleaning device capable of being in a cleaning state in which the first cleaning member and the second cleaning member are in pressure contact with the transfer body and a non-cleaning state in which the first cleaning member and the second cleaning member are away from the transfer body, wherein the second cleaning member is provided to be away from the transfer body in arrear from separation of the first cleaning member when the cleaning state is shifted to the non-cleaning state, and when "t" represents a time lag between time when the first cleaning member is away from the transfer body and time when the second cleaning member is away from the transfer body, "v" represents a moving velocity of the transfer body and "L" represents a distance between top ends of the first cleaning member and the second cleaning member on the transfer body when the top ends are away from the transfer body, a relation $L<Vt$ is satisfied.

12. The cleaning device according to claim 11, wherein when "b" represents a contact width between the first cleaning member and the transfer body, a relation $L+b<Vt$ is satisfied.

13. An image forming apparatus, comprising:

a transfer body for retaining an image formed with a developer; and a cleaning device for cleaning the transfer body, wherein the cleaning device comprises:

a cleaning blade having a first end that is brought into pressure contact with the transfer body;

a cleaning member which is placed downstream from the cleaning blade with respect to a moving direction of the transfer body so as to be rotatable with respect to the cleaning blade and whose first end is brought into pressure contact with the transfer body; and a support for the cleaning member, the cleaning member support holding an end of the cleaning member that is distal from the transfer body, the support for the cleaning member being pivotable about a rotation point, wherein the support for the cleaning member is rotatably biased away from the cleaning blade and toward the transfer body, wherein the support for the cleaning member is mounted on the cleaning blade, wherein the cleaning blade is supported for rotation about a supporting point so that the cleaning blade moves together with the cleaning member to and from the transfer body, and wherein the cleaning blade and the cleaning member are biased toward the transfer body about the supporting point.

14. The image forming apparatus according to claim 13, wherein a rotation center of the cleaning member is positioned with respect to the cleaning blade.

15. The image forming apparatus according to claim 13, wherein a rotation center of the cleaning member is positioned with respect to a housing of the cleaning device.

16. The image forming apparatus according to claim 13, wherein the cleaning member can rotate with respect to the cleaning blade in a range free from generation of creep deformation when the first end is brought into pressure contact with the transfer body.

17. The image forming apparatus according to claim 13, wherein a biasing force is applied to the cleaning member that is equal to or less than a limit quantity for preventing creep deformation of the cleaning member.

18. The image forming apparatus according to claim 13, wherein a rotation center of the cleaning member is placed in a position free from attachment of a developer or undesired substances removed by the cleaning blade or the cleaning member.

19. The image forming apparatus according to claim 13, wherein the cleaning device is capable of being in a cleaning state in which the cleaning blade and the cleaning member are in pressure contact with the transfer body and a non-cleaning state in which the cleaning blade and the cleaning member are away from the transfer body, and wherein the cleaning member is provided to be away from the transfer body in arrear from separation of the cleaning blade when the cleaning state is shifted to the non-cleaning state.

20. The image forming apparatus according to claim 13, further comprising a control section for bringing the cleaning device into pressure contact with or away from the transfer body with specified timing.

21. The imaging forming apparatus according to claim 13, wherein the cleaning member pivots about a second end of the cleaning member.

22. The imaging forming apparatus according to claim 13, wherein the first end of the cleaning blade is the most upstream end of the cleaning blade with respect to the moving direction of the transfer body.

23. An image forming apparatus, comprising:

a transfer body for retaining an image formed with a developer; and a cleaning device for cleaning the transfer body, wherein the cleaning device comprises:

a first cleaning member whose top end is brought into pressure contact with the transfer body; and a second cleaning member which is placed downstream from the first cleaning member with respect to a moving direction of the transfer body so as to be rotatable with respect to the first cleaning member and whose top end is brought into pressure contact with the transfer body, wherein the cleaning device is capable of being in a cleaning state in which the first cleaning member and the second cleaning member are in pressure contact with the transfer body and a non-cleaning state in which the first cleaning member and the second cleaning member are away from the transfer body, and wherein the second cleaning member is provided to be away from the transfer body in arrear from separation of the first cleaning member when the cleaning state is shifted to the non-cleaning state, and when "t" represents a time lag between time when the first cleaning member is away from the transfer body and time when the second cleaning member is away from the transfer body, "v" represents a moving velocity of the transfer body and "L" represents a distance between top ends of the first cleaning member and the second cleaning member on the transfer body when the top ends are away from the transfer body, a relation $L<Vt$ is satisfied.

24. The image forming apparatus according to claim 23, wherein when "b" represents a contact width between the first cleaning member and the transfer body, a relation $L+b<Vt$ is satisfied.

* * * * *